US005136268A

United States Patent [19]

Fiedziuszko et al.

[11] Patent Number: 5,136,268

[45] Date of Patent: Aug. 4, 1992

[54] MINIATURE DUAL MODE PLANAR FILTERS

[75] Inventors: Slawomir J. Fiedziuszko, Palo Alto; John A. Curtis, Sunnyvale, both of Calif.

[73] Assignee: Space Systems/Loral, Inc., Palo Alto, Calif.

[21] Appl. No.: 688,038

[22] Filed: Apr. 19, 1991

[51] Int. Cl.[5] ..... H01P 1/203; H01P 7/08

[52] U.S. Cl. ..... 333/204; 333/219; 333/995; 505/866

[58] Field of Search ..... 333/202, 204, 205, 134, 333/219, 995, 219.1, 212; 505/866

[56] References Cited

U.S. PATENT DOCUMENTS

| | | | |
|---|---|---|---|
| 3,796,970 | 3/1974 | Snell, Jr. | 333/134 |
| 4,780,691 | 10/1988 | Fiedziuszko | 333/235 X |
| 4,918,050 | 4/1990 | Dworsky | 333/219 X |

FOREIGN PATENT DOCUMENTS

| | | | |
|---|---|---|---|
| 0099002 | 6/1983 | Japan | 333/204 |
| 1062809 | 12/1983 | U.S.S.R. | 333/219 |

OTHER PUBLICATIONS

J. A. Curtis and S. J. Fiedziuszko, "Miniature Dual Mode Microstrip Filters", Digest of the MTT symposium, Boston, Mass., Jun. 1991.

*Primary Examiner*—Eugene R. LaRoche
*Assistant Examiner*—Seung Ham
*Attorney, Agent, or Firm*—John S. Ferrell; Edward J. Radlo

[57] ABSTRACT

A dual mode microstrip resonator (1) usable in the design of microwave communication filters. The substantially square resonator (1) provides paths for a pair of orthogonal signals which are coupled together using a perturbation located in at least one corner of the resonator (1). The perturbation can be introduced by notching (3) the resonator (1) or by adding a metallic or dielectric stub (5) to the resonator (1).

9 Claims, 3 Drawing Sheets

(a)

(b)

(c)

MINIATURE DUAL MODE PLANAR FILTERS

BACKGROUND OF THE INVENTION

1. Field of the Invention

This invention relates to high frequency electronic circuits, and more particularly to microwave communication filters implemented using planar transmission line fabrication techniques.

2. Description of Background Art

Design techniques for single mode planar microwave filters, such as broadside edge coupled filters, have long been established. Implementation of planar microwave filters is often achieved using microstrip and stripline fabrication techniques. Microstrip is formed by etching a circuit pattern on one side of two metal layers separated by a dielectric substrate. The unetched side serves as a ground plane. Stripline circuits are fabricated by etching a metal layer sandwiched between two dielectric layers having outer surfaces coated by metal ground planes. These single mode planar filters, however, are of limited utility for most high performance microwave applications due to their typically high insertion loss and their impracticality for filter passbands of less than 5%. The high performance requirements for communication satellite frequency multiplexers typically require the use of dual mode cavity or dielectric resonator filters to realize self equalized, quasi-elliptic responses having pass bands often less than 1%. These filters have the drawbacks of relatively large size and high cost.

In U.S. Pat. No. 3,796,970 by Snell, an orthogonal resonant filter was disclosed in which the two surface dimensions are each designed to be one-half the wavelength of a desired frequency. FIG. 1 shows the resonator 2 of Snell having a rectangular shape with side lengths of $1_1$ and $1_2$. Signal conductors 4 are used to couple signals to and from resonator 2. Accordingly, the element supports two resonant orthogonal standing waves, and external coupling to each wave can be provided independently.

In Soviet Union patent no. 1,062,809, a rectangular resonator is shown with inputs and outputs electromagnetically coupled to the resonator.

In Japanese patent no. 58-99002, an adjustable notch in a slot line ring is disclosed for tuning the center frequency and bandwidth of a microwave filter.

SUMMARY OF THE INVENTION

In accordance with the present invention, a dual mode microstrip resonator (1) is used in the design of high performance microwave communication circuits. A perturbation is added to dual mode resonator (2) of the prior art (shown in FIG. 1) at a point that lies on an axis of symmetry (6) formed by the bisection of characteristic vectors (13,15). Vectors (13,15) represent orthogonal dual modes which characterize the resonator (2) of the prior art. This perturbation added to resonator (1) facilitates coupling between the two orthogonal modes within resonator (1). By coupling the orthogonal modes in the manner of the present invention, each resonator (1) can be used to realize a second order transfer functions (having two frequency poles). Combining multiple resonators (1) enables the efficient realization of higher order filter circuits.

BRIEF DESCRIPTION OF THE DRAWINGS

FIG. 2(*b*) is a top view of a dual mode microstrip type resonator 9 comprising stub 5;

FIG. 2(*c*) is a top view of a dual mode microstrip type resonator 11 comprising hole 7;

DESCRIPTION OF THE PREFERRED EMBODIMENTS

Figure 1:
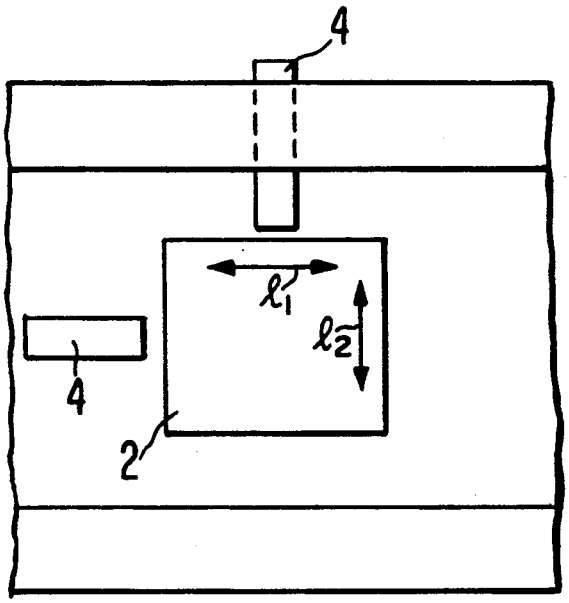
FIG. 1 PRIOR ART
FIG. 1 is a top view of a prior art microstrip type planar transmission line illustrating a dual mode resonator 2.
Figure 3:
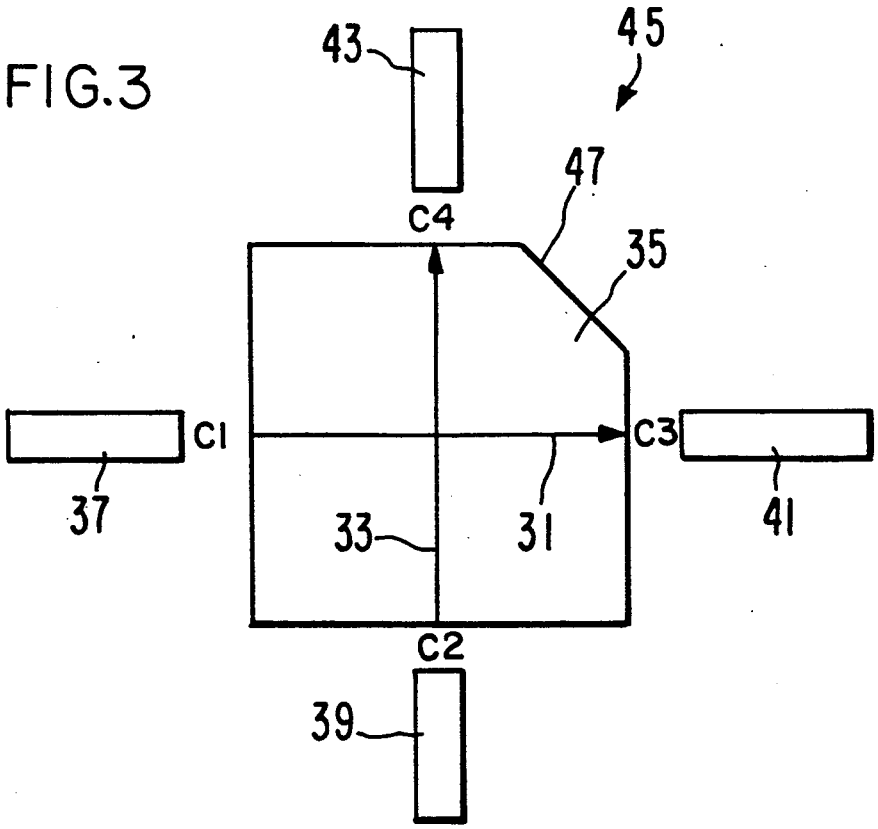
FIG. 3 is a top view of a dual mode microstrip type filter 45 comprising resonator 35 of the present invention and coupling transmission lines 37, 39, 41 and 43.
Figure 2:
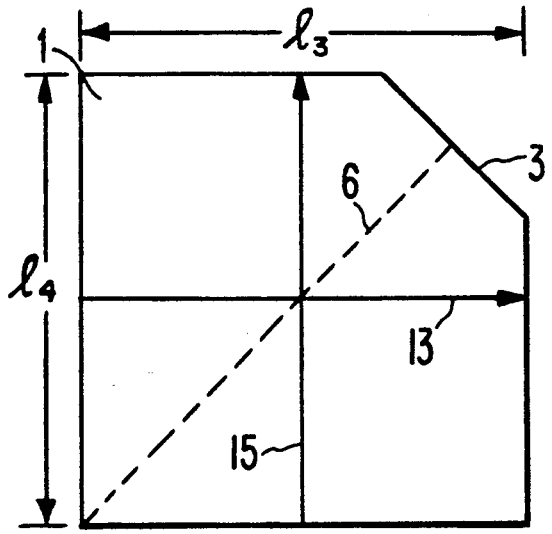
FIG. 2(*a*) is a top view of a dual mode microstrip type resonator 1 comprising notch 3.
Figure 2:
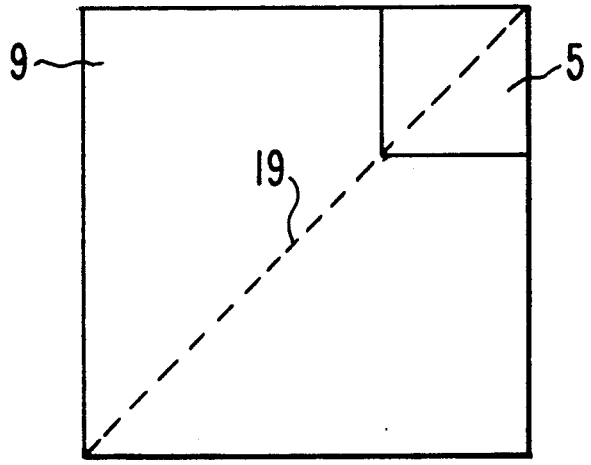
Figure 2:
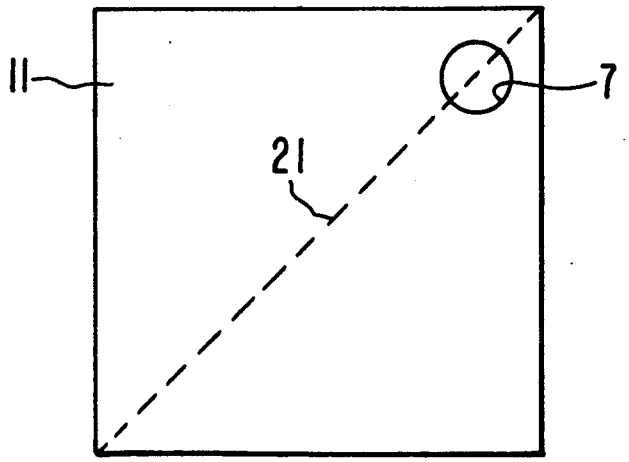

Referring now to FIG. 2(*a*), a dual mode microstrip resonator 1 of the present invention is shown. In the preferred embodiment, resonator 1 is substantially square in shape, having side lengths $1_3$ and $1_4$ which are equal to the half wave lengths of the orthogonal resonant signals represented by characteristic vectors 13 and 15 respectively. Vectors 13 and 15 are bisected by axis of symmetry 6. Coupling notch 3 lies perpendicular to axis of symmetry 6 in such a manner that axis 6 bisects the notch 3. Coupling notch 3 causes each of the resonant signals represented by vectors 13 and 15 to symmetrically reflect nd couple with the corresponding signal in the orthogonal direction.

Since the purpose of the notch 3 is to distort or perturb the resonant signals, any placement of the notch 3 which distorts the signal will effect coupling of the orthogonal signals. Characteristic vectors 13, 15 can be drawn in any orientation such that they are parallel to the edges of the resonator, and the notch 3 can be placed accordingly with respect to a bisecting axis of symmetry 6, as described above. It is also possible to effect coupling by using multiple notches 3 or perturbations located in various corners of resonator 1. The variability of notch orientation is demonstrated in FIG. 5 where notches 67 alternate. In FIG. 6, three of the resonators 77 have three notches 79 which are oriented to the interior of the circuit while a fourth is randomly oriented outward.

Use of a substantially square resonator 1 provides an advantage over narrow single mode resonant filters by providing higher Q, since the losses are reduced by the wide geometrical dimensions available in the direction of resonance. These Q factors are significantly improved when superconductive materials are used in constructing the circuitry. Also, the use of substantially square resonators facilitates the realization of dual mode designs and elliptic functions and self equalized planar filter designs.

Referring now to FIG. 2(*b*), a resonator 9 of the present invention is shown with a stub 5 perturbation. This stub 5 operates as an alternative to notch 3 in FIG. 2(*a*), to couple together the two independent orthogonal modes traversing resonator 9. This stub 5 can be constructed in any symmetrical shape and of any material which perturbs the electromagnetic fields resident on resonator 9. The stub 5 can be formed by depositing a metallic or dielectric material on the surface of resonator 9. The shape of stub 5 is not critical except that the geometry should produce a symmetrical signal reflection (half on each side) relative to axis of symmetry 19.

FIG. 2(*c*) shows a resonator 11 which uses a hole 7 as a coupling means instead of stub 5. As in stub 5 of FIG. 2(*b*), the hole should produce a symmetrical signal reflection relative to axis of symmetry 21. Input conductor leads 37 and 39 are used to provide electromagnetic signals to resonator 35. The inputs 37, 39 and outputs 41, 43 are capacitively coupled to resonator 35 through gaps C1–C4 respectively. The signal entering resonator 35 from input 37 introduces an electromagnetic signal which resonates along characteristic vector 31. Input conductor lead 39 introduces a signal which resonates along characteristic vector 33 orthogonal to vector 31. Notch 47 causes each of the resonant signals represented by vectors 31 and 33 to symmetrically reflect and couple with the corresponding signal in the orthogonal direction. Coupling between the inputs 37, 39 and resonator 35 is arranged so that the input 37, 38 strips are centered with respect to the edge of the resonator 47. Although this configuration provides coupling at a point of maximum resonant signal strength, alternate coupling schemes are well known in the art as disclosed by U.S. Pat. No. 3,796,970. Output 41 and output 43 are used to deliver coupled signal components from resonator 35.

Figure 4:
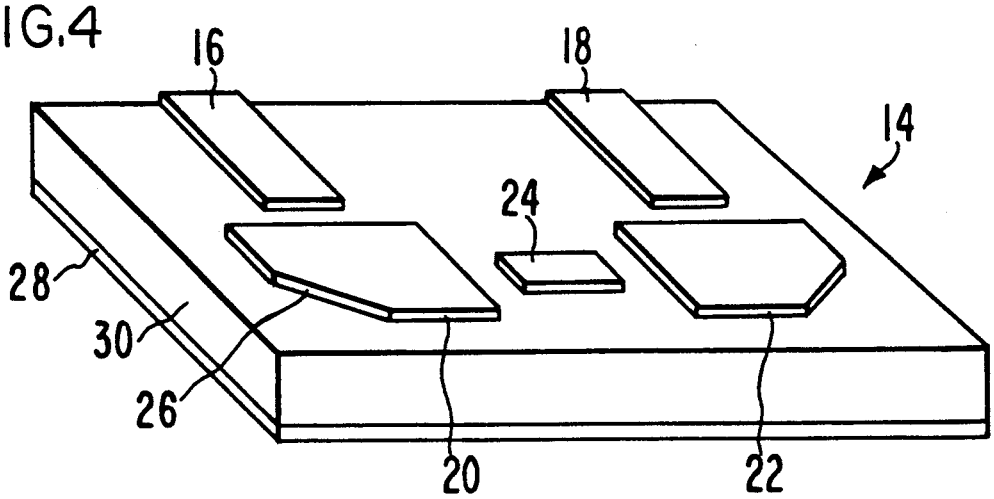
FIG. 4 is a relief view of a fourth order filter utilizing dual mode resonators 20, 22 of the present invention.

Referring now to FIG. 4, a relief view of a fourth order filter utilizing dual mode resonators 20, 22 of the present invention is shown. The circuit structure is fabricated by constructing dielectric substrate 30 over conductive ground plane 28. Various circuit components 16, 20, 24, 22, 18 are then deposited or etched using microstrip or strip line planar fabrication techniques. In the fourth order filter of FIG. 4, conductor lead 16 provides an input signal to resonator 20. The dual pole generation of resonator 25 is effected through the notch 26 coupling of orthogonal signal components. The second order signal is then transmitted along conductor lead 24 to the second resonator element 22 where additional second order filtering is introduced. The output signal of this fourth order circuit is sampled along output 18.

Figure 5:
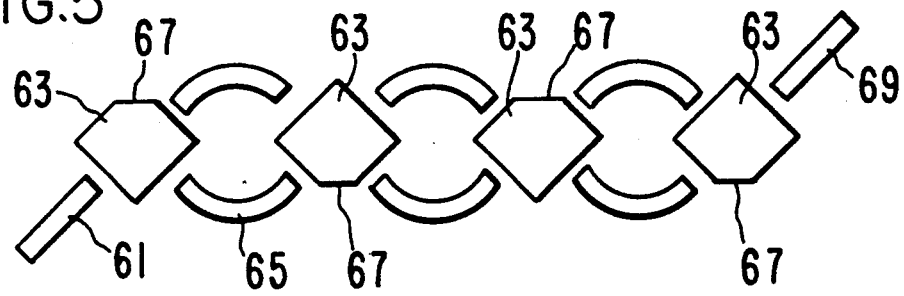
FIG. 5 is a top view of an eighth order filter utilizing dual mode resonators 63 of the present invention.
Figure 6:
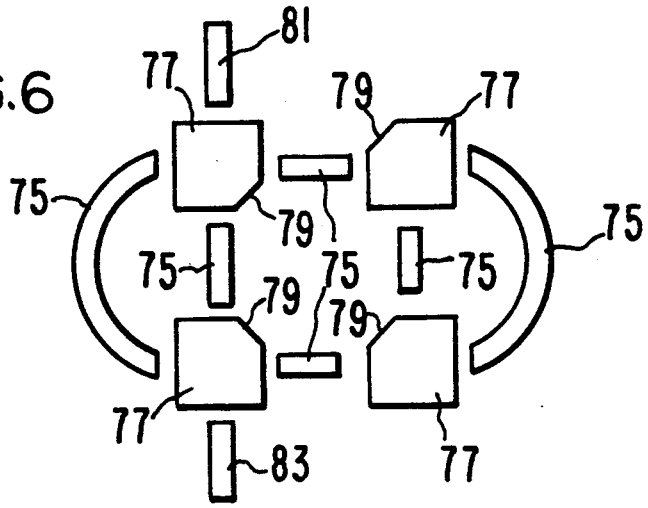
FIG. 6 is a top view of an eighth order filter utilizing dual mode resonators 77 of the present invention.

Referring now to FIG. 5, an eighth order filter using four dual mode resonators 63 of the present invention is shown. The input signal is continuously sampled at input 61, filtered through resonator elements 63, and coupled by conductor leads 65. The eighth order output of this filter structure is sampled by output 69.

Referring now to FIG. 6, an alternative embodiment of an eighth order filter using dual mode resonators 77 of the present invention is shown. The input signal to this circuit is provided through input 81. Resonators 77 each provide a second order (two pole) effect through coupling of two orthogonal components facilitated by notches 79. The individual resonator elements 77 are coupled together by conductor leads 75, and the circuit is sampled at output 83.

The invention has now been explained with reference to specific embodiments. Other embodiments will be apparent to those of ordinary skill in the art in light of this disclosure. Therefore, it is not intended that this invention be limited, except as indicated by the appended claims.

We claim:

1. A dual mode planar filter comprising:

substantially planar substantially square resonating means having a pair of orthogonal resonating paths for conducting two modes of electromagnetic signals and having a physical perturbation means located in at least one corner of the resonating means for coupling the electromagnetic signals between the two modes, said perturbation means altering the physical dimensions of said substantially planar substantially square resonating means;

at least one signal input electromagnetically coupled to the resonating means for delivering electromagnetic signals to the resonating means such that the signals propagate along the resonating paths; and at least one signal output electrically coupled to the resonating means for delivering coupled electromatic signals from the resonating means.

2. The planar filter as in claim 1 wherein the resonating means is implemented using microstrip.

3. The filter as in claim 2 wherein the microstrip is a superconductor.

4. The planar filter as in claim 1 wherein the resonating means is implemented using strip line.

5. The filter as in claim 4 wherein the strip line is a superconductor.

6. The planar filter as in claim 1 wherein the perturbation means comprises at least one notch for disturbing orthogonal electromagnetic signals, resulting in the coupling of electromagnetic signals.

7. The planar filter as in claim 1 wherein the perturbation means comprises a metallic stub for disturbing orthogonal electromagnetic signals, resulting in the coupling of the electromagnetic signals.

8. The planar filter as in claim 1 wherein the perturbation means comprises of a dielectric stub for disturbing orthogonal electromagnetic signals, resulting in the coupling of the electromagnetic signals.

9. The planar filter of claim 1 wherein said at least one signal input and output are electromagnetically coupled to the resonating means by a capacitive gap.

* * * * *